United States Patent [19]

Horton et al.

[11] 4,297,965

[45] Nov. 3, 1981

[54] TENSION LEG STRUCTURE FOR TENSION LEG PLATFORM

[75] Inventors: Edward E. Horton, Portuguese Bend; Raymond W. Walker, Huntington Beach, both of Calif.

[73] Assignee: Deep Oil Technology, Inc., Irvine, Calif.

[21] Appl. No.: 73,096

[22] Filed: Sep. 6, 1979

[51] Int. Cl.[3] ..... B63B 35/44

[52] U.S. Cl. ..... 114/265; 114/294; 285/140; 285/391; 403/342

[58] Field of Search ..... 114/293, 294, 264, 265; 403/342; 405/222, 224, 225; 285/140, 138, 390, 391

[56] References Cited

U.S. PATENT DOCUMENTS

| | | | |
|---|---|---|---|
| 906,217 | 12/1908 | Gaylord | 285/391 |
| 2,031,878 | 2/1936 | Couter | 403/342 X |
| 2,274,477 | 2/1942 | Howard et al. | 285/140 X |
| 2,399,611 | 5/1946 | Armstrong . | |
| 2,775,095 | 12/1956 | Harris | 405/225 X |
| 2,939,291 | 6/1960 | Schurman et al. . | |
| 3,017,934 | 1/1962 | Rhodes et al. . | |
| 3,154,039 | 10/1964 | Knapp . | |
| 3,196,958 | 7/1965 | Travers et al. . | |
| 3,355,899 | 12/1967 | Koonce et al. . | |
| 3,523,578 | 8/1970 | Adan, Jr. et al. . | |
| 3,559,223 | 2/1971 | Lockwood, Jr. et al. | 114/294 |
| 3,605,668 | 9/1971 | Morgan . | |
| 3,648,638 | 3/1972 | Blenkarn . | |
| 3,780,685 | 12/1973 | Horton . | |
| 3,934,528 | 1/1976 | Horton et al. . | |

*Primary Examiner*—George E. A. Halvosa
*Attorney, Agent, or Firm*—Poms, Smith, Lande & Rose

[57] ABSTRACT

A tension leg structure for use with a tension leg platform or the like to interconnect an anchor on the sea floor and platform in which the tension leg structure comprises interconnected buoyant pipe members for transmitting tension forces and for withstanding hydrostatic pressure. Each member has internal watertight bulkheads defining a buoyancy chamber. Tremie pipe extends through the bulkheads of each member and has ends terminating in a slipover coupling provided within a joint interconnecting adjacent tension buoyant members.

8 Claims, 6 Drawing Figures

TENSION LEG STRUCTURE FOR TENSION LEG PLATFORM

BACKGROUND OF INVENTION

Tension leg platforms are shown in U.S. Pat. Nos. 2,399,611, 3,154,038, 3,648,638, 3,780,685, and 3,934,528. Such tension leg platforms generally comprise a partially submerged floatable platform connected to suitable anchor means on the sea floor by tension members. Such tension members or tension legs generally comprise wire cable, chain, and pipe. Tension is applied to the tension legs by selected ballasting of the platform so that a buoyant upwardly directed force is exerted on the tension legs.

Prior proposed vertical members extending between a floatable platform and anchor means at the sea bottom have included neutrally buoyant vertical anchor chains comprising buoyant sections interconnected by interlocked eyes and laterally extending neutrally buoyant mooring lines, U.S. Pat. No. 2,939,291. Tension legs, including conduit members, are shown in U.S. Pat. Nos. 3,355,899 and 3,154,039.

Vertical riser or casing systems not used as tension legs include riser sections having swivel joints therebetween and maintained under tension by a float located below the surface of the water, U.S. Pat. No. 3,196,958; gimbal joints between riser sections, U.S. Pat. No. 3,523,578; the riser held in upright position by a buoyant sphere, U.S. Pat. No. 3,605,668; and a casing provided with longitudinally spaced buoyancy pods separate from the casing, U.S. Pat. No. 3,017,934.

Prior proposed tension leg platforms have included the capability of carrying anchor means in association with the platform as it is moved above a sea floor site. Such anchor means are then lowered by suitable means to the sea floor and ballasted to provide gravity, deadweight, or other suitable anchor holding forces. Prior proposed methods of ballasting an anchor means on the sea floor have included lowering an anchor shell by drill pipe, and using the drill pipe for flow of ballast material to the anchor shell, U.S. Pat. No. 3,934,528. In other prior methods of ballasting such an anchor, a separate line for conducting ballast material to the anchor shell was employed, U.S. Pat. No. 2,399,611. Such separate lines, called tremie lines, required special handling and special equipment.

SUMMARY OF INVENTION

The present invention relates to a tension leg structure which obviates some of the special equipment required for establishing an anchor means on the sea floor for a tension leg platform. The invention particularly relates to a construction of a tension leg structure in which tension forces are transmitted through certain portions of tension leg structure sections and means for providing ballast to an anchor shell are included in each section and such means are not under tension forces or require special equipment.

Generally speaking, the present invention contemplates a tension leg structure in which a plurality of independently buoyant cylindrical members are releasably interconnected by joint means whereby the cylindrical members form a pipe means for transmitting tension forces and withstanding hydrostatic pressure between the tension leg platform and an anchor means on the sea floor. Each independent cylindrical member includes coaxially disposed tremie pipe means which extends through the buoyancy chamber of the cylindrical member. Each joint means between adjacent cylindrical members encloses a coupling means for the tremie pipe means so that communication between adjacent cylindrical members is provided for the passage and flow of ballast material to an anchor shell.

Generally speaking, the present invention contemplates a method of installing a tension leg structure by lowering an anchor shell, connecting a buoyant cylindrical member to said shell and then lowering the shell and cylindrical member and adding additional cylindrical members to provide suitable length of tension leg structure. As cylindrical members are interconnected, tremie pipe means carried by each cylindrical member is simultaneously interconnected. Upon reaching a selected length of tension leg structure, a buoyant chamber is associated with the uppermost cylindrical member whereby the tension leg structure is maintained in upright vertical position by its inherent buoyancy, the top of the tension leg structure being below the sea surface and the top of the tension leg structure carrying tension lines to be grasped and connected to the tension leg platform for imparting necessary tension to the tension leg structure.

A primary object of the present invention, therefore, is to provide a novel tension leg structure which is efficient and economical to handle and which obviates many of the disadvantages of prior proposed tension leg structures.

An object of the present invention is to provide a tension leg structure which includes a plurality of independently buoyant cylindrical members interconnected for transmittal of tension forces.

Another object of the present invention is to provide a novel tension leg structure in which each cylindrical member includes a buoyancy chamber defined by transverse bulkheads at opposite ends of the cylindrical member, the amount of buoyancy of each cylindrical member being related to its proposed location in the tension leg structure whereby the tension leg structure is approximately neutrally buoyant.

A further object of the present invention is to provide in each cylindrical member a coaxially positioned tremie pipe which extends in sealed relation through said bulkheads for passage of ballast material from the platform to the anchor means.

A still further object of the present invention is to provide at each joint means between adjacent cylindrical members a construction suitable for transmitting tension forces and for also housing coupling means for ends of tremie pipe carried by each cylindrical member.

A further object of the invention is to provide a joint means between tension leg members which comprise tension force transmitting portions and nontension force transmitting portions wherein some nonaxial relationship of said portions at the joint means is provided and tolerated.

Various other objects and advantages of the present invention will be readily apparent from the following description of the drawings in which an exemplary embodiment of the invention is shown.

IN THE DRAWINGS

Figure 3A:
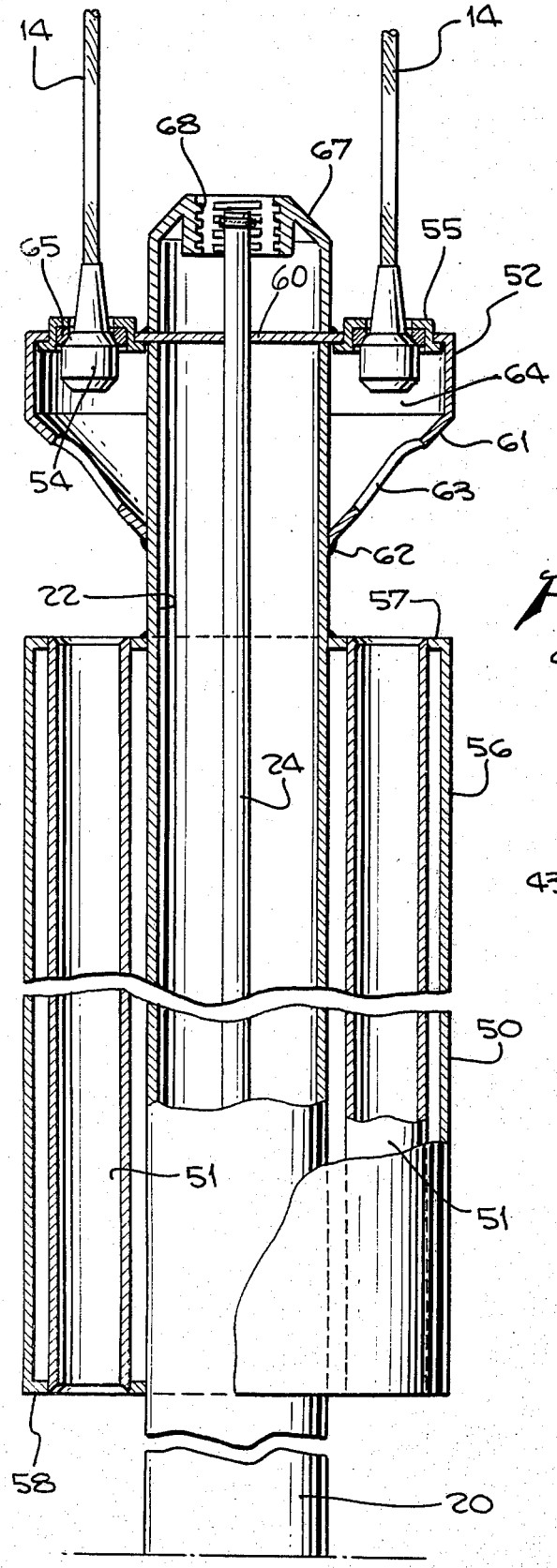

FIG. 3*a* is an enlarged fragmentary sectional view of the upper attachment assembly for connecting the tension leg structure to the tension leg platform.

Figure 3B:
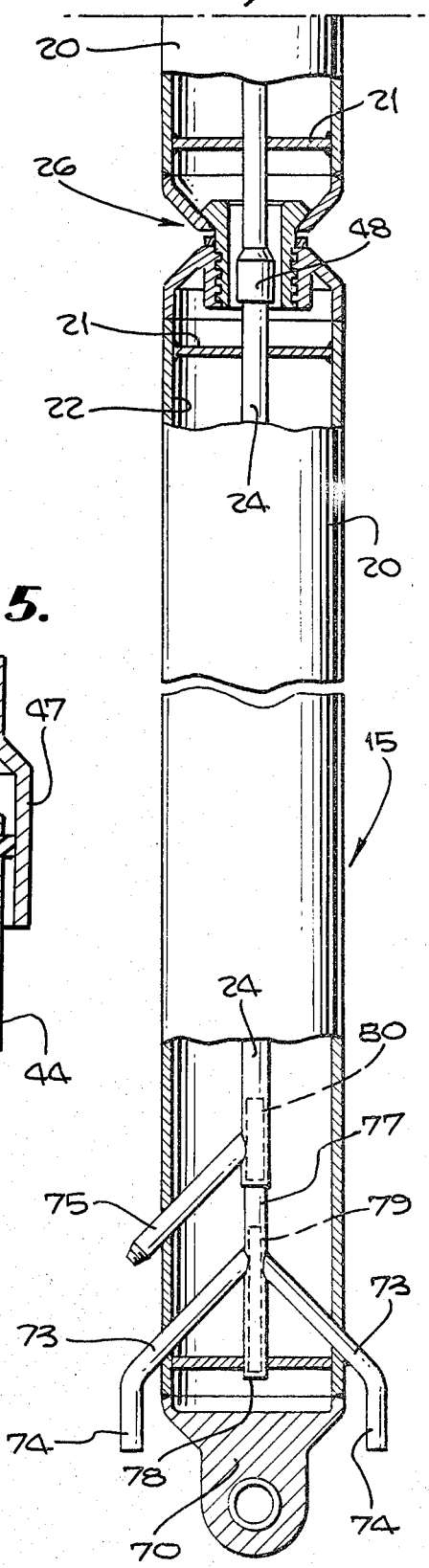

FIG. 3*b* is a partial sectional view showing a typical joint means between members of the tension leg and the lower portion of the lowermost tension leg member for connection to the anchor means.

Figure 4:
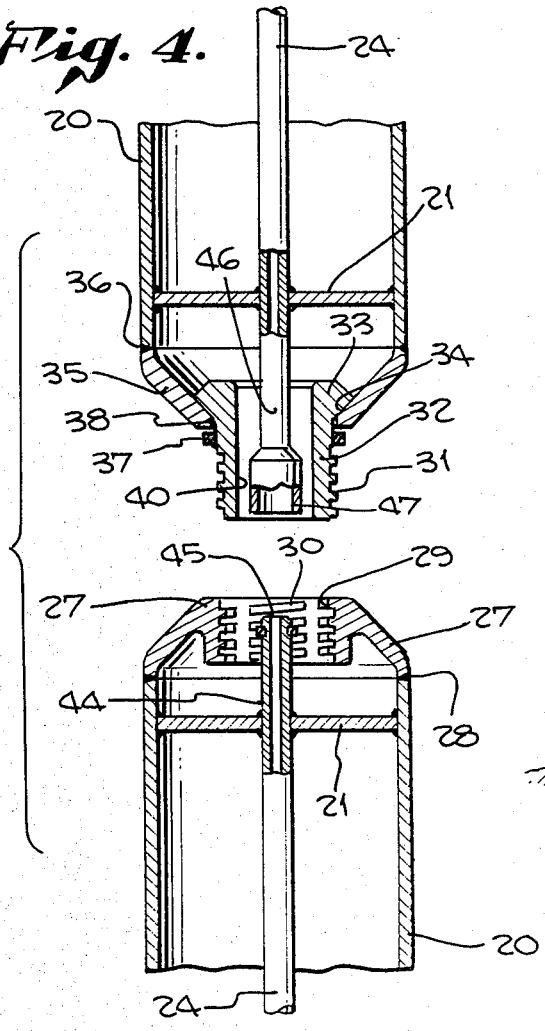

FIG. 4 is an enlarged fragmentary exploded sectional view of a joint means and a coupling means within the joint means.

Figure 5:
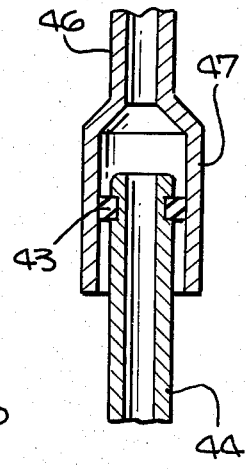

FIG. 5 is a fragmentary enlarged partially sectional view of the tremie joint in assembled relation.

Figure 2:
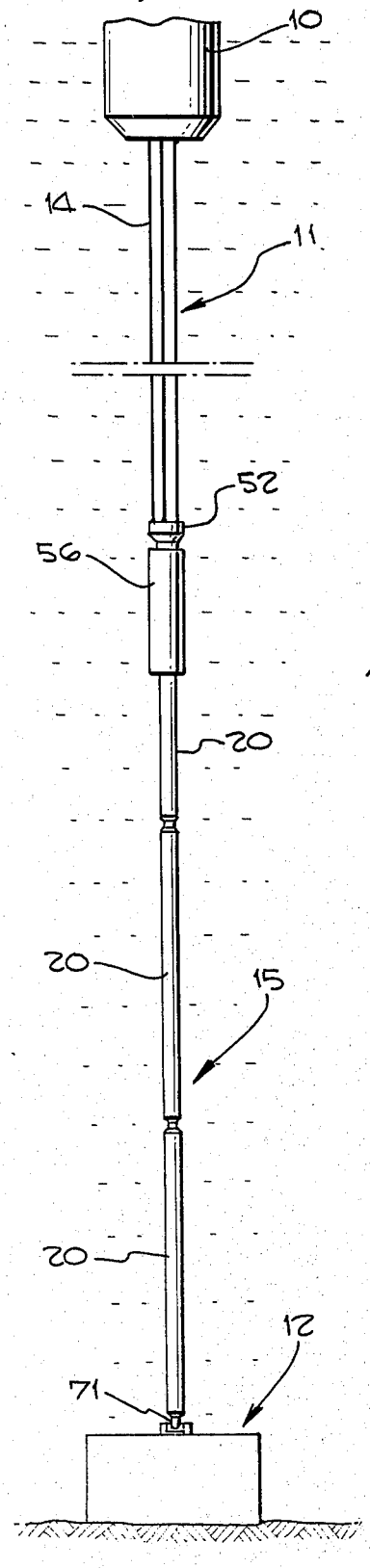
FIG. 2 is an elevational view showing the tension leg connected to a buoyant vertical column of a tension leg platform, the column being only partially shown.

Referring first to FIG. 2, a tension leg platform, of which only a fragmentary lower part 10 of one of the vertical buoyant columns of the platform is shown, may include the structure shown in my U.S. Pat. No. 3,780,685, or other typical tension leg platforms such as shown in U.S. Pat. Nos. 3,648,638, 3,154,038 and 2,399,611. Generally speaking, such tension leg platforms include a platform deck supported on a buoyant structure which is partially submerged and provided with sufficient buoyancy to exert an upwardly directly tension force on tension leg means generally indicated at 11. The tension leg means 11 is connected at its lower end to a deadweight anchor means 12 or to other suitable fixed or removable anchor means. In this example, tension leg means 11 comprises a plurality of upper tension cables 14 connected to the tension leg platform in suitable manner for tensioning as by winch means (not shown) and connected in force transmitting relation to the upper end of a tension leg structure embodying this invention. The connection of the tension lines 14 to the tension leg structure may be similar to that shown in U.S. Pat. Nos. 3,550,549 and 3,709,182 owned by a common assignee.

Tension leg structure 15 comprises a plurality of independently buoyant cylindrical members or portions 20 for transmitting tension forces and an internal tremie pipe or portion 24 for nontransmittal of tension forces. Each member 20 includes a transverse wall or bulkhead 21 adjacent each end to define therebetween a buoyant chamber 22. Bulkheads 21 may be suitably welded to its cylindrical member and to a tremie pipe 24 which extends coaxially through member 20 and through bulkhead 21. Air chamber 22, together with a selected wall thickness of cylindrical member 20, provides a buoyant member 20 having preselected buoyant characteristics. Thus, buoyant members 20 at different vertical locations along the string of cylindrical members may provide positive buoyant forces so that a string of connected buoyant cylindrical members 20 may be essentially freestanding.

Joint means generally indicated at 26 releasably interconnect adjacent ends of members 20. Each joint means 26 includes on the end of one cylindrical member 20 an internally threaded end cap 27 welded as at 28 to member 20. End cap 27 has a generally conical shape providing an axial opening 29 having internal arcuate breech lock type thread portions 30 for cooperation with externally disposed thread portions 31 on fitting 32 carried by the adjacent end of the adjacent member 20. Fitting 32 has an enlarged upper end or head portion 33 having a part-spherical face 34 provided swivel relationship with a complementary face on the conical shaped end cap 35 secured as by welding at 36 to adjacent member 20. Fitting 32 includes an annular shoulder ring 37 welded thereto which loosely cooperates with the margins of cap opening 38 and the enlarged portion 33 to permit rotation of fitting 32 about the longitudinal axis of member 20 and limited swiveling or off axial movement of fitting 32. Fitting 32 has a throughbore 40.

When joint means 26 is made up at an installing vessel 42 (FIG. 1), fitting 32 is inserted into the cap opening 29 for a selected number of annular threads and then rotated in one direction to cause interengagement of the internal and external threads. Such interengagement of the internal and external threads is limited in rotation to cause interlocking engagement of the lower end cap 27 and the fitting 32. The cooperable thread portions 30 and 31 may be slightly pitched to allow the thread portion 31 of cap 27 to contact or bottom out against an end thread portion 30.

As mentioned above, a tremie pipe 24 is fixed coaxially in each member 20. The ends of the tremie pipe 24 extend through the bulkheads 21 and into the end space provided by the end caps 27 and 35 and into fitting 32. In this example, the end portion 44 of the lowermost member 20 is provided with a plain end having a tapered end face 45. The plain end is interrupted by an annular groove within which is seated a seal ring 43 of rectangular cross section. End portion 46 of the tremie pipe 24 of the uppermost member 20 is provided with an enlarged socket 47 for sliding reception of the plain end 44 therewithin when the joint means 26 is made. Seal ring 43 slidably engages the internal surface of socket 47 which has an inner diameter sufficiently greater than the outer diameter of the end 44 to provide clearance for axial misalignment to the extent required and permitted by swiveling of end 33 of fitting 32 on surface 34. Stressing of tremie pipe ends 44 and 46 between bulkheads 21, to which the tremie pipes are fixed is thereby avoided and minimized. The socket 47 and plain end 44 provide a tremie coupling means 48 made up within the joint means 26 and serving to provide communication through the tremie pipe from one member 20 to the adjacent member 20.

At the uppermost buoyant cylindrical member 20, FIG. 3*a*, additional buoyancy means 50 encircles member 20 for a distance depending upon the buoyant force required to support the tension leg structure in upright position including the weight of the tension lines 14 which, when not connected to the tension leg platform 10, will pass through sleeves 51 in the buoyant means 50 for suspension alongside member 20 and from an enlarged crosshead 52. Lines 14 include an enlarged weighted end 54 having a diameter permitting the end 54 to loosely slide through the sleeve 51 on the buoyancy means 50. The upper end of tension line 14 may carry a suitable connecting head adapted to rest on the upper surface of a cup-shaped boss 55 carried by crosshead 52.

Buoyancy means 50 includes a suitable cylindrical member 56 closed at opposite ends by end walls 57, 58, except for the openings of sleeves 51.

Crosshead 52 includes a transverse wall 60 which provides a bulkhead for defining chamber 22 in the uppermost member 20. Tremie pipe 24 extends through bulkhead 60. Crosshead 52 includes a generally tapered wall 61 which converges to the outer cylindrical surface of member 20 and may be suitably welded thereto as at 62. Tapered wall 61 is provided with ports 63 aligned with sleeves 51 for passage therethrough of enlarged ends 54 of the tension lines 14. Externally of member 20, crosshead 52 may be reinforced by suitable diametrically disposed members 64. It may be noted that each of the cup shaped bosses 55 may be provided with insert rings 65 for seating of the enlarged ends 54 of lines 14.

The upper end of the uppermost member 20 includes a conical cap wall 67 provided with cross threads 68 in a manner similar to the joint means 26.

The lowermost cylindrical member 20 may be provided with an end closure 70 formed to provide a universal joint 71 for connection to the anchor means 12.

Figure 1:
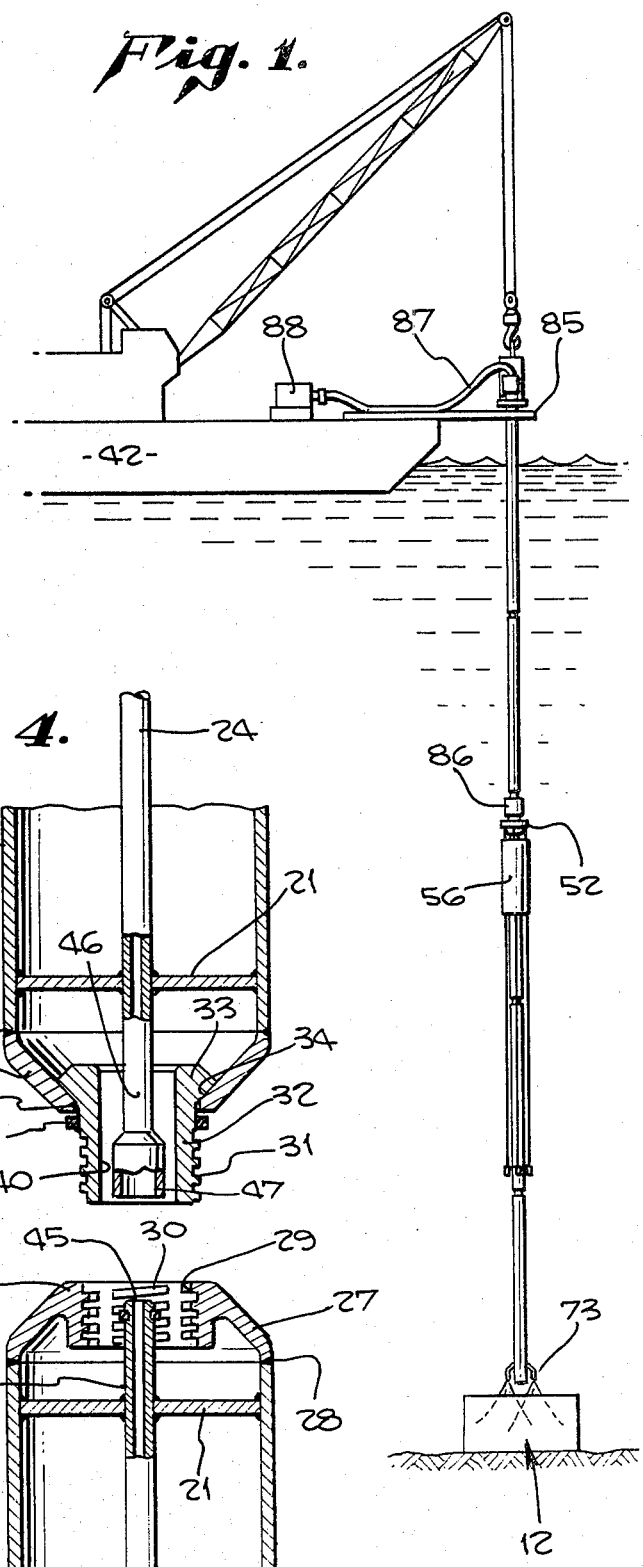
FIG. 1 is an elevational view of a tension leg structure embodying this invention connected between an anchor means and a vessel used to install the tension leg, and fill the anchor means with concrete by use of the tension leg structure.

The tremie pipe 24 in the lowermost member 20 may be provided with divergent pipes 73 extending through the cylindrical wall of member 20 and having a downwardly bent nozzle end 74 for flow of ballast into the anchor means 12 as generally indicated in FIG. 1. The lower portion of tremie pipe 24 also includes an angularly disposed nipple 75 located above the divergent pipes 73 and extending through the wall of member 20 for connection to a conduit which leads to a jet ring surrounding an anchor caisson adapted to be jetted by water into the seabed.

At the bottom portion of the tremie pipe 4, which is provided with the divergent pipes 73, it will be noted that the bottom portion 77 is of reduced diameter and has a closed end 78. Flow of ballast into the divergent pipes 73 is controlled by a retrievable wire line sleeve valve 79. In the position shown in FIG. 3*b*, sleeve valve 79 has closed the divergent pipes 73.

Flow through angularly disposed nipple 75 is similarly controlled by a retrievable wire line sleeve valve 80 which may have an outer diameter sufficient to abut the shoulder formed by the change in diameter between the tremie pipe 24 and reduced bottom tremie pipe portion 77. When sleeve valve 80 is in the position shown in FIG. 3*b*, nipple 75 is closed and flow of ballast material may be conducted therethrough to the divergent pipes 73, it being understood that sleeve valve 79 is not in place.

Installation of tension leg structure 15 may employ a conventional derrick barge wherein anchor shell 12 may be floated into position below the spider deck 85 of the vessel 42. Anchor means 12 may be provided with universal joint 71 and lowermost buoyant member 20 may be connected to the anchor shell. The anchor shell may be flooded and thereby submerged until the next buoyant member 20 may be connected to the lowermost member. Such connection may be readily made by reason of the construction of the joint means 26 as described above. Fitting 32 is lowered into end cap 27 and the breech lock threads interengaged by turning the fitting 32 relative to the end cap 27. At the same time that the upper member 20 is lowered, coupling of the tremie pipe is also accomplished.

Interconnection of buoyant members 20 is continued until the desired height of tension leg structure is obtained. The uppermost buoyant member 20 carries the buoyancy chamber 50 and also the crosshead means 52 to which the tension lines 14 are connected. Tension lines 14 lie alongside buoyant members 20 as shown in FIG. 1.

Additional buoyant members 20 or their equivalent are connected above the upper member 20 so that as shown in FIG. 1, a tremie hose 87 may be connected to the tremie pipe in the tension leg structure and ballast pumped through pump means 88 through the tremie pipe for the length of the tension leg structure and to the anchor 12 on the sea floor. Anchor means 12 is filled with a selected weight of ballast to serve as a gravity anchor to withstand the tension forces which might be applied to the tension leg structure.

After the anchor means 12 is ballasted, the upper buoyant members 20 above crosshead 52 may be removed by disconnecting landing tool 86 and a suitable pennant attached to the crosshead so that the location of the installed tension leg structure can be readily found. It will be understood that the tremie pipe may be flushed to remove ballast material.

The structural features of the tension leg structure described above permit tension forces to be transmitted through the shell of each buoyant member and through joint means 26 which comprise the welded end caps on buoyant members 20 and fitting 32. Tremie pipe 24 does not carry a tension load. Each member 20 is reinforced against lateral loads by the bulkheads 21 at opposite ends and by the tremie pipe which is welded to the bulkheads 21. Each member 20 is, therefore, relative rigid and adjacent members are permitted limited axial misalignment.

It is also important to note that the tension leg structure of this invention, when subjected to lateral loading by ocean currents and other forces, is capable of limited relative movement between members 20 at the joint means 26. Since each member 20 is approximately neutrally buoyant, the tension leg structure below the crosshead 51 is readily made free-standing by the upper buoyancy chamber 50.

The tension leg means for an offshore platform as described above thus includes a buoyant tension leg structure comprising a plurality of interconnected tension leg members each including a tension transmitting cylindrical member providing a buoyant chamber, a nontension transmitting tremie pipe extending through said chamber, a joint means for interconnecting adjacent cylindrical members with limited swivel or universal motion therebetween, a slidable coupling between adjacent tremie pipe ends also permitting limited off axis relative movement, and a buoyant means to support interconnected tension leg members in free-standing mode, and tension means to connect the upper end of the buoyant tension structure with the platform.

It will be readily understood by those skilled in the art that various changes and modifications may be made in the tension leg structure described above which come within the spirit of this invention and all such changes and modifications coming within the scope of the appended claims are embraced thereby.

We claim:

1. In combination:

a floatable offshore platform;

a plurality of anchor means adapted to be set on the ocean floor;

a plurality of tension leg means extending between and connected to the platform and to respective anchor means;

each tension leg means including a tension leg structure and tension lines, each leg structure comprising:

a plurality of interconnected independently buoyant members having a buoyancy to provide an essentially freestanding structure;

each buoyant member including a hollow cylindrical member, a fluid tight bulkhead adjacent each end of said cylindrical member to form a closed buoyant compartment, and a tremie pipe member within said cylindrical member and extending through said bulkheads in sealed relation therewith and having pipe extensions beyond said bulkheads;

joint means threadedly interconnecting adjacent independently buoyant members in tension force transmitting relation;

the adjacent pipe extensions of said tremie pipe members having a coupling providing fluid communication therebetween within said joint means;

a buoyant cylinder means carried by each of the uppermost of said independently buoyant members to provide additional positive buoyancy to support said plurality of buoyant members in such freestanding relation;

a crosshead means carried by said uppermost buoyant member;

said tension lines having lower ends positionable and connectible in force transmitting relation with said crosshead means and adapted to extend to said platform;

said tension lines in non-force transmitting relation being supported by said buoyant members and cylinder means and lying alongside said buoyant members.

2. A combination as stated in claim 1 wherein each independently buoyant member of said tension leg structure includes a construction having a preselected buoyancy related to its depth position in the tension leg structure.

3. A combination as stated in claim 1 wherein said joint means includes a joint member at one end of a buoyant member, said joint member having a swivel seat on said end of said buoyant member permitting limited swivel motion of said buoyant member with respect to an adjacent buoyant member.

4. A combination as stated in claim 3 wherein said joint means includes a mating joint member on the other adjacent buoyant member, said mating joint members having slightly pitched cooperable breech lock type threads.

5. A combination as stated in claim 1 wherein said adjacent pipe extensions of said tremie pipe members include an enlarged socket on one pipe extension for loosely receiving the cooperable pipe extension on the adjacent tremie pipe, and a seal means therebetween for fluid tight communication between said pipe extensions while permitting limited axial misalignment of said tremie pipe extensions.

6. In combination with a floatable platform and an anchor means at the sea floor adapted to be ballasted and deballasted, the provision of:

a tension leg means including an essentially freestanding tension leg structure connected at its bottom to said anchor means, and tension lines adapted to connect said tension leg structure with said platform;

said tension leg structure comprising a plurality of interconnected independently buoyant members each of a preselected buoyancy, each buoyant member comprising:

an elongated hollow cylindrical member, fluid tight bulkheads at adjacent ends of said member to form a closed buoyant compartment, and a tremie pipe member extending longitudinally within the cylindrical member and having pipe extensions through said bulkheads and outside of said closed compartment, one pipe extension having an enlarged socket and the pipe extension at the other end having an enlarged seal ring cooperably receivable within said socket of an adjacent pipe extension;

and threaded joint members provided at opposite ends of said buoyant members whereby each buoyant member may be sequentially joined to an adjacent member with the tremie pipe members engageable in sealed fluid communication.

7. A method of installing an essentially freestanding tension leg structure having a plurality of interconnected buoyant members, each buoyant member having a permanent tremie pipe member adapted to be interconnected in fluid communication with adjacent tremie pipe members, including the steps of:

providing an anchor having a compartment to be ballasted;

connecting to said anchor a first elongate buoyant member having a selected buoyancy and a fixed tremie pipe member in communication with anchor; threadedly connecting a second elongate member having a selected buoyancy to the first elongate member and interconnecting their tremie pipe members; threadedly connecting in seriatim additional elongate members and interconnecting their fixed tremie pipe members to the second elongate member and its tremie pipe member until a selected length of tension leg structure is provided;

ballasting said anchor compartment by passing ballast material through said interconnected fixed tremie pipe members;

one of said elongate members having an additional buoyancy portion for supporting tension lines alongside said one elongate member and to maintain said tension leg structure in freestanding position.

8. A method as stated in claim 7 including the step of connecting said tension lines to a floating platform;

and transmitting tension forces through said elongate members and said tension lines.

* * * * *